United States Patent [19]

Blanchard et al.

[11] 4,296,963

[45] Oct. 27, 1981

[54] FIREARM SHOOTING SUPPORT TABLE

[76] Inventors: Kenneth G. Blanchard, Rt. 5, Box 484; Reuben N. Ronne, Rte. 3, Box 470 R, both of Detroit Lakes, Minn. 56501

[21] Appl. No.: 85,213

[22] Filed: Oct. 16, 1979

[51] Int. Cl.[3] ..... A47B 83/02; A47B 3/14

[52] U.S. Cl. ..... 297/170; 108/99; 108/100; 297/135; 297/156

[58] Field of Search ..... 297/170, 171, 172, 173, 297/174, 135, 143, 156, 159; 108/99, 100, 101

[56] References Cited

U.S. PATENT DOCUMENTS

| | | | |
|---|---|---|---|
| D. 250,743 | 1/1979 | Berkman et al. | D6/177 |
| 1,049,159 | 12/1912 | Simmel | 297/174 X |
| 2,973,803 | 3/1961 | Mickelson | 297/170 X |
| 3,322,460 | 5/1967 | Leverman | 297/156 |

FOREIGN PATENT DOCUMENTS

| | | | |
|---|---|---|---|
| 166286 | 7/1950 | Austria | 297/171 |
| 982637 | 6/1931 | France | 297/170 |
| 1031173 | 6/1953 | France | 297/170 |

*Primary Examiner*—James T. McCall
*Attorney, Agent, or Firm*—Robert E. Kleve

[57] ABSTRACT

A shooting table device having a table portion for supporting a firearm and seat portion for supporting the operator while firing the firearm with the firearm resting on the table portion. The table has a pair of front legs to support the front of the table. The seat portion has a pair of horizontal extending support members extending from the seat, and which are pivotably mounted to the front legs of the table to pivotably support the seat portion of the front of the table. The horizontally extending support members are telescoping to adjust the seat toward or away from the table. The seat portion has a pair of legs mounted to the seat portion of the rear of the table to support the rear end of the seat separate from the table. The table also has a support leg at its rearward end to support the rearward end of the table.

2 Claims, 5 Drawing Figures

FIREARM SHOOTING SUPPORT TABLE

This invention relates to tables or stands for supporting and firing firearms.

It is an object of the invention to provide a novel stand or table for persons to place a firearm thereon.

It is another object of the invention to provide a novel stand or table to support a firearm and an operator of a firearm in a proper position to fire the firearm.

Further objects and advantages of the invention will become apparent as the description proceeds and when taken in conjunction with the accompanying drawings therein.

Briefly stated, the invention comprises a shooting stand having a table portion for supporting a firearm and a seat portion for supporting an operator while firing the firearm, the seat portion is positioned near one corner end of the rear of the table and has a pair of legs mounted to the rear of the seat to support the seat at one end separate from the table. The table has front legs extended forward from the seat. Horizontal bars are fixed to the seat at their rearward ends and are mounted to the front legs of the table in pivoting relation at their forward ends and the table portion has a leg at its rearward end to support the table portion independently of the seat so that the rear table portion and rear seat portions of the seat are separately supported on the ground to allow for irregularities in the ground with respect to the rear seat portion and the rear table portion.

Figure 1:
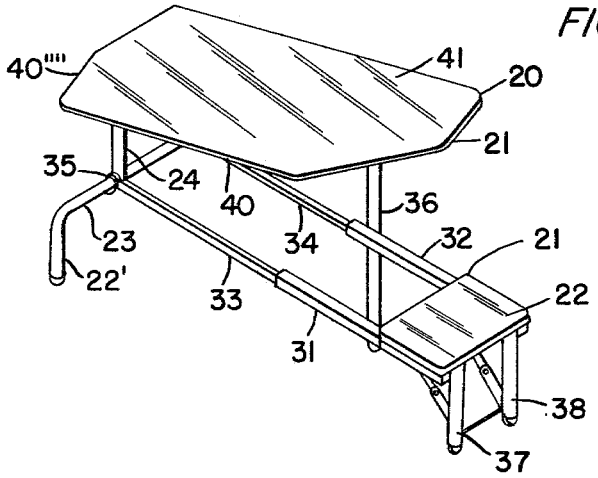
FIG. 1 is a perspective view of the firearm table or stand invention.

Referring more particularly to the drawings in FIG. 1, the shooting stand or table invention 20 is illustrated as having a table 21 and a seat 22. The front of the table 21 has a pair of foldable front legs 22'. The front legs are formed by an inverted U-shaped member 23. A pair of upright posts 24 and 25 are fixed to the U-shaped member 23 and extend upward therefrom. The upper ends 24' and 25' are pivotably mounted to the table by a pair of hinges 26 and 26'. A pair of conventional foldable braces 27 and 28 are mounted between the posts 24 and 25 and the table to lock the posts and the inverted U-shaped member forming the legs in an upright position as illustrated.

The seat member 22 has a rectangular panel 30 which acts as a seat to support an operatior in a seated position thereon. The panel member 30 has a pair of horizontally extending tubes or rods 31 and 32 fixed underneath the seat.

A pair of horizontal rods 33 and 34 are slidably mounted in the hollow rods 31 and 32. The horizontal rods 33 and 34 have a collar 35 and 36 which are rotatably mounted to the inverted U-shaped member 23, whereby the seat may be adjusted or moved horizontally relative to the table by sliding the hollow rods 31 and 32 in telescoping relation on the horizontal rods 33 and 34 toward and away from the front legs formed by the member 23.

The panel member 30 also has a pair of legs 37 and 38 which are pivotably mounted to the rearward edge of the panel member 30, and a pair of conventional locking braces to lock the legs in their upright position and enabling them to be folded to a parallel folded position when desired by folding the brace upright.

The table invention 20 also has a rear leg member 36 pivotably mounted to the rearward post of the table and which is also supported in an upright position by a conventional brace 36' so that the leg 36 may be folded to a parallel position illustrated in dashed lines, when the table or stand is callapsed for storing .

The panel member 30 being pivotably mounted at its forward end to the inverted U-shaped frame member 23 enables the seat member to pivot upward and downward relative to the table to allow the seat to pivot to rest on ground which is sometimes at a different elevation from the table leg 36, so that the table and seat 30 will rest more firmly on the ground, the seat member 30 at its rearward end being supported by its legs 37 and 38 and the table being supported at its rearward end by leg member 36, separately of one another.

Also, by the seat member being supported at its forward end at the forward end of the table, transmits some of the weight of the operator, when seated on the panel member 30, to the forward end of the table. Also, the parallel telescoping members 31 and 32, 33 and 34 give a more even weight distribution so that the table will not tip over very easily, as it would if the forward end of the panel member 30 were mounted to the rearward edge of the table, for example.

Figure 2:
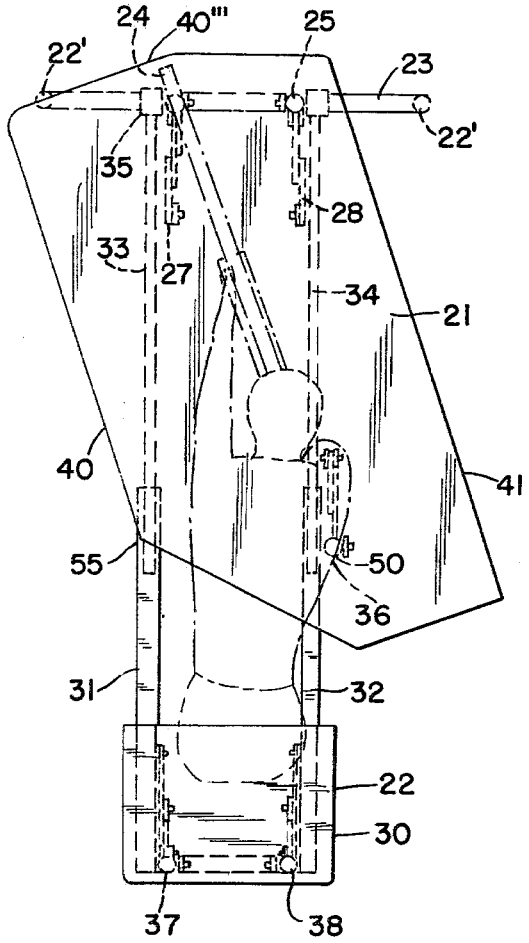
FIG. 2 is a top plan view of the firearm table invention illustrating an operator firing a firearm thereon while seated on the seat part of the invention.
Figure 3:
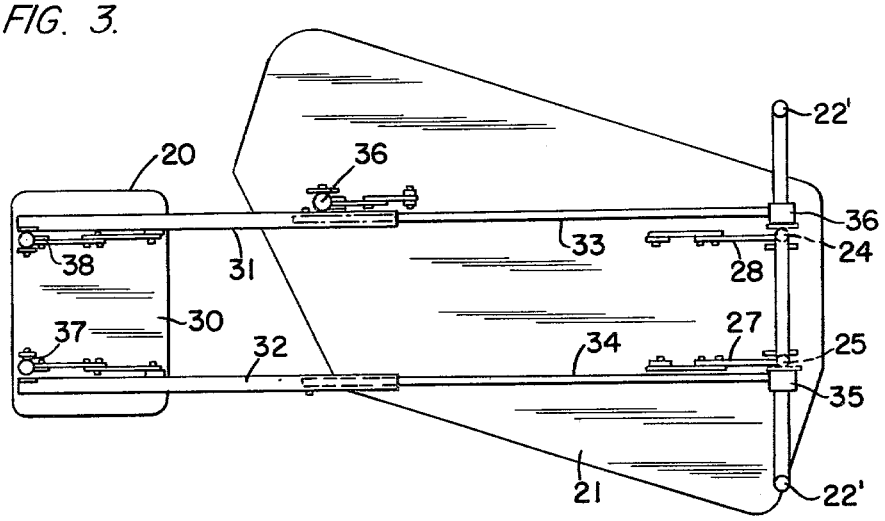
FIG. 3 is a bottom view of the firearm table invention.
Figure 4:
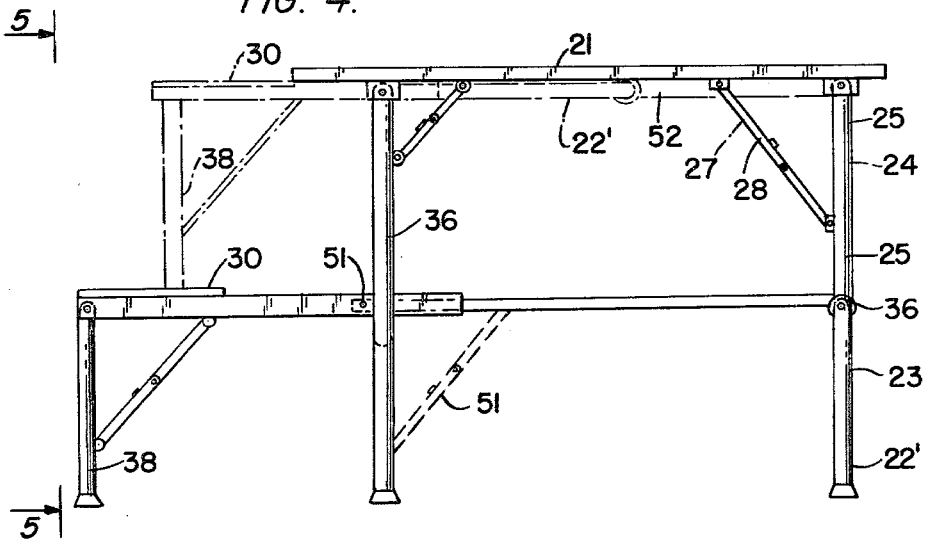
FIG. 4 is a side view of the firearm table invention.
Figure 5:
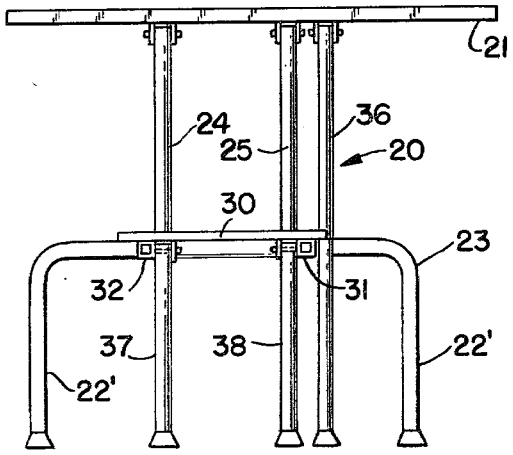
FIG. 5 is a rear view of the firearm table invention.

Also, when the operator is in a normal position to fire the firearm 51, as illustrated in FIG. 2, the barrel 52 of the firearm 51 will be turned or positioned at an angle with respect to the operator's body 53 for the most comfortable position for shooting. For this reason the table has been turned at an angle, with respect to the seat, so that the side edge 40 and 41 of the table will be parallel to the length of the gun barrel, and the side of the seat and the sides of the support members 31, 32, 33, and 34 will be parallel to the sides of the operator's body. The table is aligned with its front edge 40''' perpendicular to the target.

Thus, it will be seen that a novel firearm stand or shooting table has been provided which enables the operator to comfortably fire a firearm from a seated position and which assists aligning the firearm for firing, and which is more stable on irregular terrain.

Also, the telescoping action of the panel 30, relative to the table, enables the seat to be adjusted toward and away from the table depending upon the preference of each operator.

Also, conventional locking pins 50 may be mounted to lock the telescoping legs 31 and 32 to the members 33 and 34 in their fully telescoped position, as illustrated in FIGS. 1 and 2. Also, the stand or table may be easily collapsed for storage by folding the rear table leg 36 into parallelism with the table, sliding the panel member 30 forward by sliding the telescoping members 31 and 32 on the members 33 and 34 until they reach the position shown in phantom lines 51 and then pivoting the front legs 23 of the table rearward to a parallel position immediately beneath the table which also pivots panel member 30 and the telescoping members 31, 32, 33, and 34 upward to their position shown in phatom lines 52 in FIG. 2, with the front legs of the table parallel immediately beneath the table and the telescoping members and panel member parallel and immediately beneath the table. Then the rear legs 37 and 38 of the panel member 30 and be folded parallel immediately beneath the panel member 30 which provides a more narrow and compact shape to the table for easy storage.

It will be obvious that various changes and departures may be made to the invention without departing from the spirit and scope thereof and accordingly it is not intended that the invention be limited to that specifically described in the specification or as illustrated in the drawing but only as set forth in the appended claims wherein.

What is claimed is:

1. A shooting table device comprising a table for supporting a firearm, a seat for supporting an operator while firing the firearm, with the firearm supported on the table, said table having a pair of front legs pivotally mounted to the front of said table and adapted to extend vertically from said table for supporting said table, at least one telescoping horizontal supporting means, one end of said telescoping means being pivotally mounted to the front legs of said table at a height intermediate the height of said table, the telescoping means having its other end fixed to said seat, said pivotal mounting of said one end of said telescoping means to said front legs of said table serving as front legs for said seat, said seat having a pair of legs mounted to support said seat at its rearward end, said telescoping means enabling said seat to be adjusted forward and rearward with respect to said table, said table extending in length at an angle across said seat, said table having a leg at its rearward end to support the rearward end of said table.

2. A shooting table device according to claim 1 wherein said pair of legs of said seat are pivotally mounted to said seat.

* * * * *